US005197932A

United States Patent [19]

Smith, IV

[11] Patent Number: 5,197,932

[45] Date of Patent: Mar. 30, 1993

[54] GANGED EXERCISE SHOES

[75] Inventor: Christopher J. B. Smith, IV, Oceanport, N.J.

[73] Assignee: Prostretch, Inc., Little Silver, N.J.

[21] Appl. No.: 722,605

[22] Filed: Jun. 27, 1991

[51] Int. Cl.[5] ..... A63B 23/08

[52] U.S. Cl. ..... 482/79; 482/146; 482/907

[58] Field of Search ..... 482/79, 80, 146, 77, 482/907

[56] References Cited

U.S. PATENT DOCUMENTS 3,295,847 1/1967 Matt, Sr. ..... 482/80
3,472,508 10/1969 Baker et al. ..... 482/79
4,708,339 11/1987 Perrine ..... 482/146

*Primary Examiner*—Richard J. Apley
*Assistant Examiner*—Lynne A. Reichard
*Attorney, Agent, or Firm*—R. Gale Rhodes, Jr.

[57] ABSTRACT

Apparatus for simultaneously producing dorsiflexion and plantarflexion in both lower legs and both feet of a person and including a pair of exercise shoes for receiving the feet of the person, each exercise shoe including a generally semi-circular base for engaging a support surface on which the exercise shoes rock, and ganging means such as a pair of ganging bars for ganging the exercise shoes together to cause the exercise shoes to be rocked forwardly together to simultaneously produce plantarflexion and to cause the exercise shoes to be rocked rearwardly together to simultaneously produce dorsiflexion.

2 Claims, 3 Drawing Sheets

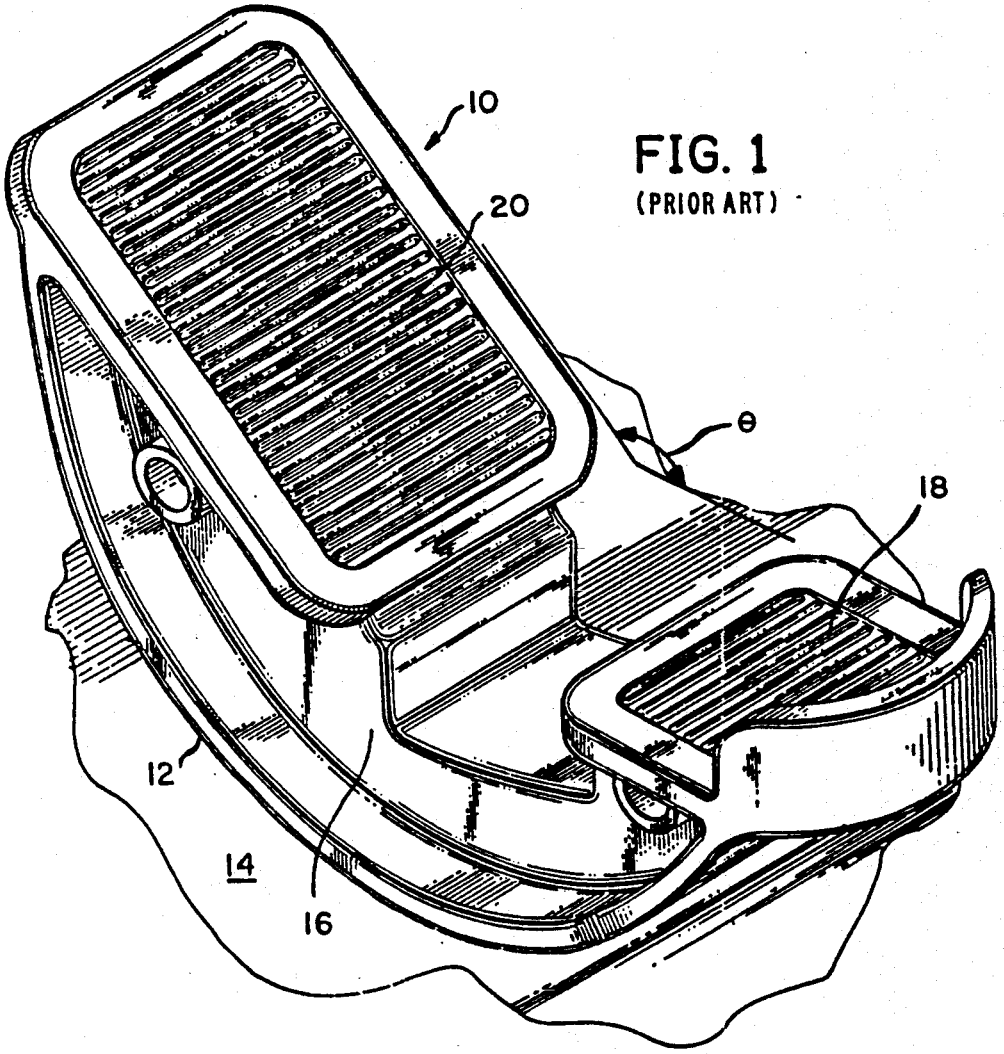
FIG. 1
(PRIOR ART)
FIG. 2
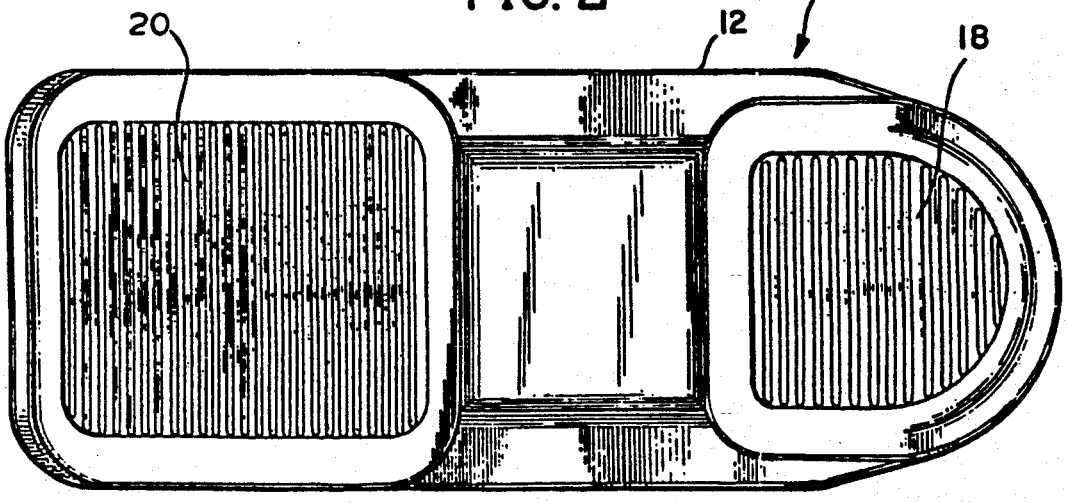

GANGED EXERCISE SHOES

BACKGROUND OF THE INVENTION

This invention relates to an improvement in the exercise shoe disclosed in U.S. Pat. No. 4,951,938 entitled EXERCISE SHOE, patented Aug. 28, 1990, Christopher J. B. Smith IV inventor and assigned to the same assignee as the present invention, and an improvement in the exercise shoe disclosed in design patent application Ser. No. 07/476,672, filed Feb. 8, 1990, entitled STRETCHING DEVICE FOR ROCKING THE FOOT TO STRETCH THE LOWER LEG, Christopher J. B. Smith IV inventor and assigned to the same assignee as the present invention; such exercise shoes are for sequentially stretching and strengthening various muscles and tendons in the lower legs and feet of a person; i.e. the person places a first foot on the exercise shoe and rocks the exercise shoe to stretch and strengthen various muscles and tendons in a first lower leg and foot and then the person places a second foot on the exercise shoe and rocks the exercise shoe to stretch and strengthen various muscles and tendons in a second lower leg and foot. More particularly, this invention relates to a pair of ganged exercise shoes of the type disclosed in the aforementioned patent and patent application and wherein various muscles and tendons in both lower legs and both feet of a person may be stretched and strengthened simultaneously or symmetrically.

The exercise shoe disclosed in the above-identified patent and patent application, particularly the patent application, is illustrated in FIGS. 1 and 2 and identified by general numerical designation 10. The exercise shoe 10 includes a generally semi-circular base 12 for engaging a support surface 14, e.g. a partially shown floor 14, on which the exercise shoe 10 rocks. The exercise shoe 10 further includes a support member 16 extending generally upwardly from the base 12 and heel and ball support platforms 18 and 20 for respectively receiving the heel and ball of the foot of a person, and as may be noted from FIG. 1, the heel and ball support platforms are disposed at an acute included angle $\theta$ with respect to each other. In use, or operation, a person places a first foot on the exercise shoe 10 with the heel of the person's foot residing on the heel platform 18 and with the ball of the person's foot residing on the ball platform 20, then, the person rocks the exercise shoe 10 alternately in the forward direction in the direction of the ball platform 10, and in the rearward direction in the direction of the heel platform 18. Upon the exercise shoe 10 being rocked in the forward direction, the plantar flexion occurs stretching and strengthening the interior flexor, i.e. the anterior tibialis and extensor digitorum longus and to some extent the plantar fascia of a first lower leg and first foot, and upon the exercise shoe 10 being rocked in the rearward direction, dorsiflexion occurs stretching and strengthening the plantar flexor, i.e. the gastrocnemius and soleus calf muscles, achilles tendon and plantar fascia of the first lower leg and first foot. The person then removes the first foot and places a second foot on the exercise shoe 10 and repeats the forward and rearward rocking motions.

The prior art exercise shoe 10, FIGS. 1 and 2, has proven quite successful in producing dorsiflexion and plantarflexion and in stretching and strengthening the above-noted lower leg and foot muscles and tendons of a person's lower leg and foot, one leg and one foot at a time. However, it has been observed that some people upon using the exercise shoe 10 to exercise one lower leg and one foot more than the other and thereby undesirably tend to stretch and strengthen the muscles and tendons of one lower leg and foot more than the other. This non-symmetrical or non-uniform stretching and strengthening of the various muscles and tendons of the lower legs and feet is due perhaps, at least in part, to the fact that most people in addition to being either right-handed or lefthanded are also right-sided or left-sided. Thus, a right-sided person tends to stretch and strengthen the lower right leg and right foot more than the lower left leg and left foot and a left-sided person, vice versa.

Accordingly, it has been found that there is a need in the exercise shoe art for exercise shoe apparatus which uniformly stretches and strengthens the above-noted muscles and tendons in both lower legs and both feet of a person symmetrically or uniformly or, viewed alternatively, which stretches and strengthens the above-noted muscles and tendons in both legs and both feet of a person simultaneously.

SUMMARY OF THE INVENTION

The object of the present invention is to satisfy the foregoing need in the exercise shoe art. Apparatus satisfying such a need and embodying the present invention and which simultaneously produces dorsiflexion and plantarflexion in both lower legs and both feet of a person includes a pair of exercise shoes for receiving both feet of a person, each exercise shoe includes a generally semi-circular base for engaging a support surface on which the exercise shoes rock, and ganging means such as a pair of ganging bars for ganging the exercise shoes together to cause the exercise shoes to be rocked forwardly together to simultaneously produce plantarflexion and to cause the exercise shoes to be rocked rearwardly together to simultaneously produce dorsiflexion.

DESCRIPTION OF THE DRAWINGS

FIG. 1 is a perspective view of a prior art exercise shoe;

FIG. 2 is a top view of the exercise shoe of FIG. 1;

DESCRIPTION OF THE PREFERRED EMBODIMENT

Figure 3:
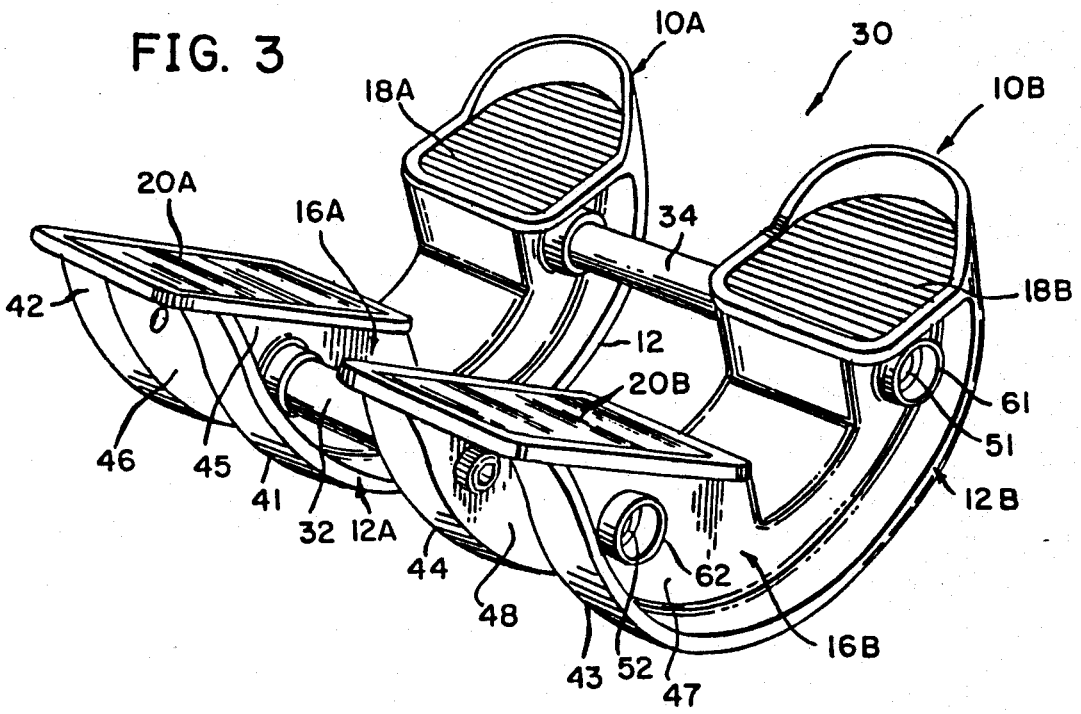
FIG. 3 is a perspective view of a pair of ganged exercise shoes embodying the present invention.
Figure 4:
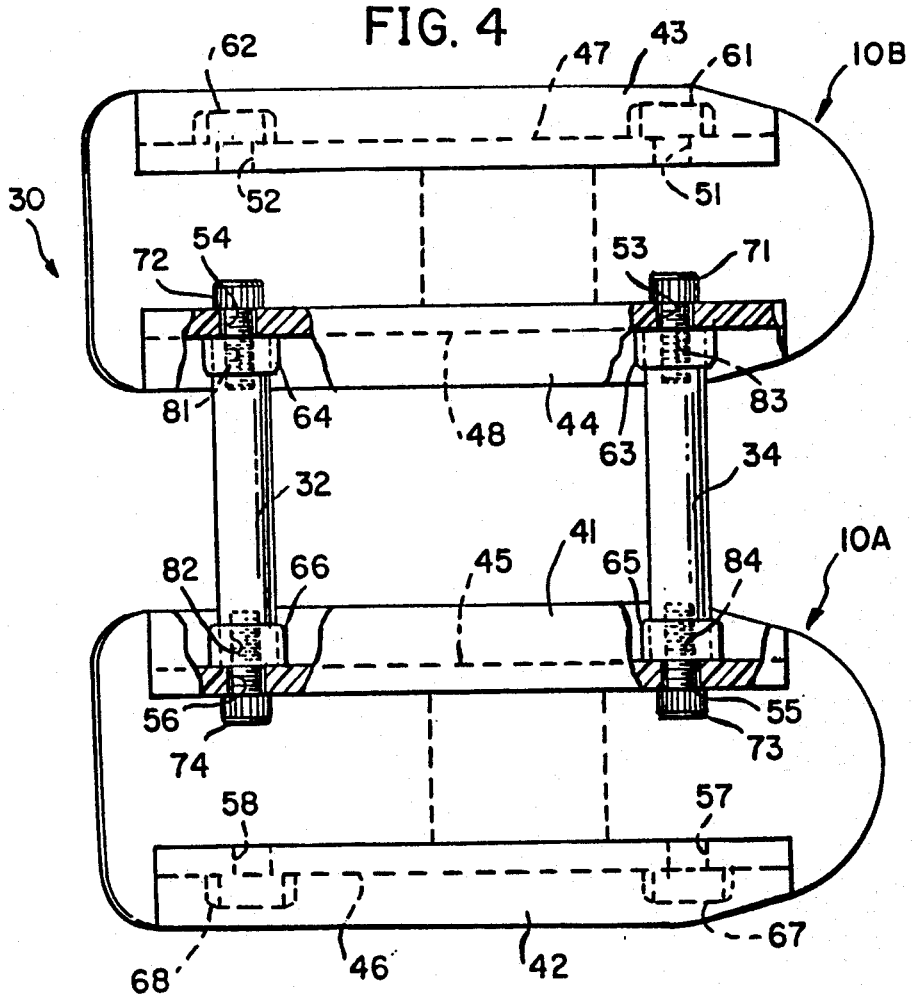
FIG. 4 is a bottom view of the ganged pair of exercise shoes of FIG. 3.
Figure 5:
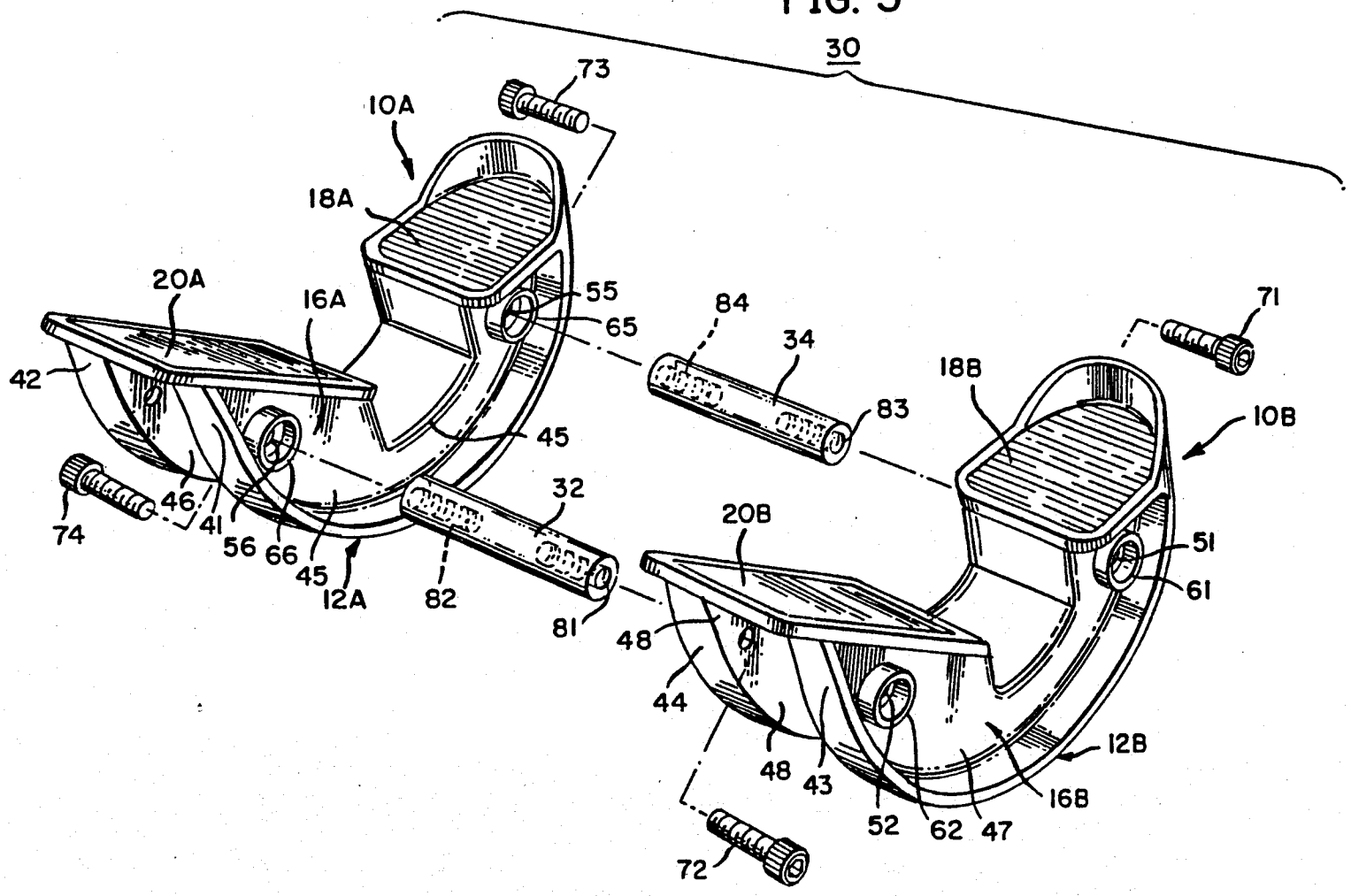
FIG. 5 is an exploded or perspective view, in perspective, of the ganged pair of exercise shoes embodying the present invention.

Referring now to FIGS. 3–5, a ganged pair of exercise shoes embodying the present invention is indicated by general numerical designation 30 and includes exercise shoe 10A and 10B. For convenience of reference, structural elements from the prior art exercise shoe 10 of FIG. 1 present in exercise shoes 10A and 10B are given the same numerical designations followed by respective alphabetical designations A and B. It will be understood from FIG. 3 that the exercise shoes 10A and 10B are ganged by being interconnected together and parallel with respect to each other by a pair of connecting bars 32 and 34 extending between the shoes and having their respective end portions secured to the shoes. More particularly, it will be understood from FIG. 3 that the interconnecting bars 32 and 34 gang the exercise shoes 10A and 10B together with the heel platforms 18A and 18B being parallel with respect to each other and with both heel platforms lying in a common plane extending therethrough, with the ball platforms 20A and 20B being parallel with respect to each other and with both ball platforms lying in a common plane extending therethrough and with the semi-circular bases 12A and 12B being parallel with respect to each other and with both bases lying in a common semi-circular plane extending therethrough; it will be noted that the base designations 12A and 12B are general designations and that as described below each base comprises a pair of semi-circular members. Thus, it will be further generally understood that upon the right heel and right ball of a person's right foot being placed on the heel platform 18A and ball platform 20A of exercise shoe 10A and with the left heel and left ball of a person's left foot being placed on the heel platform 18B and ball platform 20B of the exercise shoe 10B, and that upon the exercise shoe 30 being rocked alternately in the forward and rearward directions, the shoes rock forwardly and rearwardly parallel with respect to each other with the heel and ball platforms and bases rocking forwardly and rearwardly parallel with respect to each other whereby plantar flexion and dorsiflexion are alternately produced in both lower legs and both feet of the person and the above-noted muscles and tendons of both legs and both feet of the person are stretched and strengthened simultaneously and symmetrically.

With regard to the detailed structure of the ganged exercise shoes 30, it will be understood from FIGS. 3-5 that base 12A includes a pair of spaced apart, parallel semi-circular members 41 and 42 for engaging the support surface upon which the ganged exercise shoes 30 rock, that base 12B includes a pair of spaced apart, parallel semi-circular members 43 and 44 for engaging the support surface upon which the ganged exercise shoes 30 rock, that support member 16A includes a pair of spaced apart and parallel support members 45 and 46 extending upwardly from semi-circular members 41 and 42, and that support member 16B includes a pair of spaced apart and parallel support members 47 and 48 extending upwardly from the semi-circular members 43 and 44. As may be best understood from FIG. 4, the opposite end portions of support member 47 are provided with a pair of openings 51 and 52, that support member 48 is provided at its opposite end portions with a pair of openings 53 and 54, that support member 45 is provided at its opposite end portions with a pair of openings 55 and 56 and that support member 42 is provided at its opposite end portions with a pair of openings 57 and 58; it will be understood, and noted from FIG. 4, that such openings are for receiving threaded bolts such as threaded bolts 71 and 72 shown in FIG. 4 as being received respectively in openings 53 and 54 and bolts 73 and 74 shown in FIG. 4 as being received respectively in openings 55 and 56. As may be best understood from FIG. 5 the opposite end portions of the connecting bars 32 and 34 are respectively provided with threaded bores 81 and 82 and 83 and 84 for threadedly receiving the threaded bolts 71-74. As shown in FIGS. 3-5, particularly FIG. 4, the openings 51-58 may be surrounded with outwardly extending bosses 61-68 to facilitate alignment of the connecting bars 32 and 34 and the openings 51-58 upon pairs thereof being aligned, for example and noting FIG. 4, bosses 64 and 66 align connecting bar 32 with aligned openings 54 and 56 and bosses 63 and 65 align connecting bar 34 with aligned openings 53 and 55; the bosses 61-68 also strengthen the interconnections between the exercise shoes 10A and 10B and the connecting bars 32 and 34.

Referring now to FIGS. 4 and 5, the above-described structural elements of the pair of exercise shoes 10A and 10B are shown aligned for assembly and ganging together of the exercise shoe, and it will be understood that upon exercise shoes 10A and 10B being placed in parallel and spaced apart relationship, FIG. 4, openings 53 and 54 formed in opposite ends of support member 48 of exercise shoe 10B are aligned with openings 55 and 56 formed in support member 45 of exercise shoe 10A, the connecting bars 32 and 34 are inserted respectively into bosses 64 and 66 and 63 and 65 and are aligned respectively with the aligned openings 54 and 56 and 53 and 55 as shown in FIG. 5, the threaded bolts 71-74 are inserted into the aligned openings and threaded into the threaded bores 81-84 as shown in FIG. 5 and exercise shoes 10A and 10B are bolted together and thereby ganged.

Referring again generally to the ganged pair of exercise shoes 30, and to FIGS. 3-5, it will be understood that each exercise shoe 10A and 10B is generally symmetrical with respect to a vertical plane extending through the center thereof, that the exercise shoes 10A and 10B are structurally identical, and hence the exercise shoes 10A and 10B are interchangeable and either exercise shoe may be placed on the right or the left of the other and ganged together.

It will be understood by those skilled in the art that many variations and modifications may be made in the present invention without departing from the spirit and the scope thereof.

What is claimed is:

1. Apparatus for simultaneously producing plantarflexion and dorsiflexion in both lower legs and both feet of a person, comprising:

a pair of exercise shoes for receiving both feet of said person, each exercise shoe including a generally semi-circular base for engaging a support surface on which said shoes rock forwardly and rearwardly;

ganging means for ganging said exercise shoes together to cause said exercise shoes to be rocked forwardly together to simultaneously produce plantar flexion in both legs and both feet of said person and to cause said exercise shoes to be rocked rearwardly together to simultaneously produce dorsiflexion in both said lower legs and both feet of the said person, sand ganging means including connecting bars extending transversely with respect to said exercise shoes and said connecting bars including end portions interconnecting said shoes together and parallel with respect to each other;

each of said exercise shoes further including a ball platform for receiving the ball of said person's foot and a heel platform for receiving the heel of said person's foot, said ball and heel platforms being substantially flat and oriented at an including acute angle with respect to each other, said connecting bars also for interconnecting said shoes together with the ball platform of each shoe parallel with respect to the ball platform of the other shoe and with the ball platforms of both shoes lying in a common plane extending therethrough and with the heel platform of each shoe parallel with respect to the heel platform of the other shoe and with the heel platforms of both shoes lying in a common plane extending therethrough an with the generally semi-circular base of one shoe parallel with the semi-circular base of the other shoe and with the semi-circular bases of both shoes lying in a common semi-circular plane extending therethrough; and four threaded bolts, each connecting bar including opposed end portions provided with threaded bores for receiving two of said threaded bolts, said base of each exercise shoe comprising a pair of spaced apart, parallel semi-circular members for engaging said support surface, each exercise shoe including a pair of spaced apart and parallel support members extending upwardly from said semi-circular members, each support member having opposite end portions and each end portion provided with an opening for receiving one of said threaded bolts, upon said exercise shoes being placed in spaced apart and parallel relationship, openings formed in the opposite end portions of one of said support members of each pair of exercise shoes being aligned and upon said connecting bars being aligned with said aligned openings, said aligned openings for receiving said threaded bolts to permit said threaded bolts to be threaded into said threaded bores to bolt said exercise shoes together whereby said exercise shoes are ganged.

2. The apparatus according to claim 1 wherein said connecting bars are cylindrical and wherein said openings formed in said support members are surrounded by outwardly extending cylindrical bosses for receiving the end portions of said cylindrical connecting bars to facilitate alignment of said threaded bores of said connecting bars with said openings formed in said support members and to strengthen the interconnections between said connecting bars and said exercise shoes.

* * * * *